United States Patent [19]

Cunningham

[11] 4,010,350

[45] Mar. 1, 1977

[54] ELECTRIC HEATING ELEMENTS

[75] Inventor: Donald M. Cunningham, Pittsburgh, Pa.

[73] Assignee: Emerson Electric Co., St. Louis, Mo.

[22] Filed: June 16, 1976

[21] Appl. No.: 696,789

[52] U.S. Cl. ..... 219/465; 29/614; 219/552; 338/241; 219/274

[51] Int. Cl.[2] ..... H05B 3/68

[58] Field of Search ..... 219/465, 466, 467, 468, 219/523, 541, 552, 553; 338/238, 240, 241, 242, 250, 273, 274; 29/613, 614, 615, 616, 617

[56] References Cited

UNITED STATES PATENTS

| | | | |
|---|---|---|---|
| 712,749 | 11/1902 | Whittingham | 338/241 X |
| 1,684,184 | 9/1928 | King | 338/241 X |
| 1,735,831 | 11/1929 | Lightfoot | 29/614 X |
| 1,809,089 | 6/1931 | Wiegand | 29/614 |
| 2,455,186 | 11/1948 | McCormick | 338/241 X |
| 2,494,333 | 1/1950 | Daly | 338/241 |
| 2,632,834 | 3/1953 | Huck et al. | 338/250 |
| 2,765,391 | 10/1956 | Shroyer | 338/242 X |
| 3,087,134 | 4/1963 | McOrlly | 338/273 |
| 3,521,352 | 7/1970 | Volker | 29/611 |
| 3,920,963 | 11/1975 | Beasley | 219/523 |

*Primary Examiner*—Volodymyr Y. Mayewsky
*Attorney, Agent, or Firm*—Michael Williams

[57] ABSTRACT

An electric heating element of the metal sheathed type, particularly a range surface unit comprising a spiralled metal tube having one closed end and containing compacted refractory insulation material and a helical coil of resistor alloy insulated from the tube and connected at one end to a center return conductor and having both electrical terminations extending from the other end of the tube, the construction being such that in the event of failure of the heating element, the failure will be in a passive manner.

6 Claims, 8 Drawing Figures

FIG. 1.
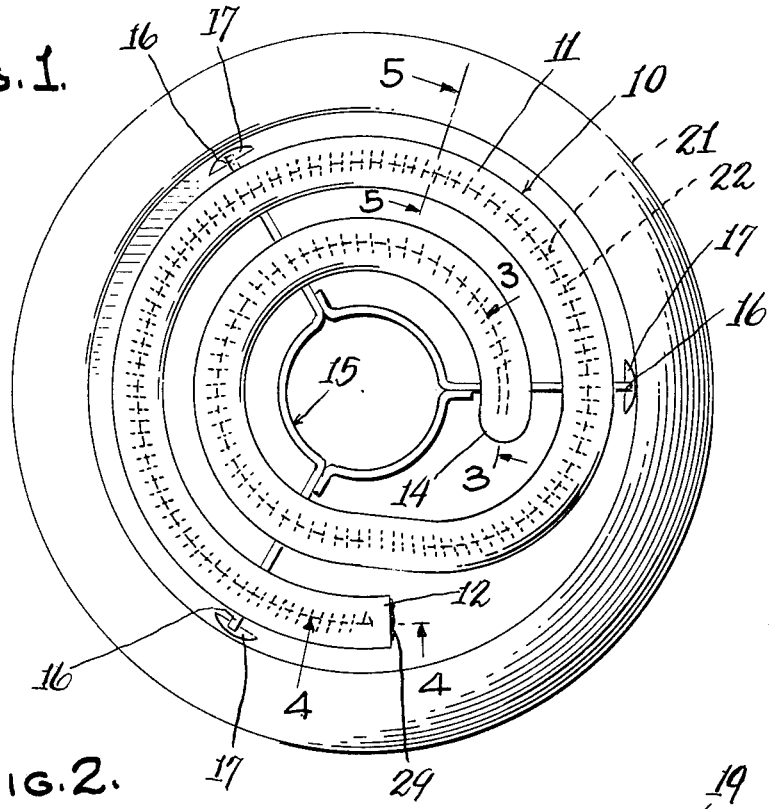
FIG. 2.
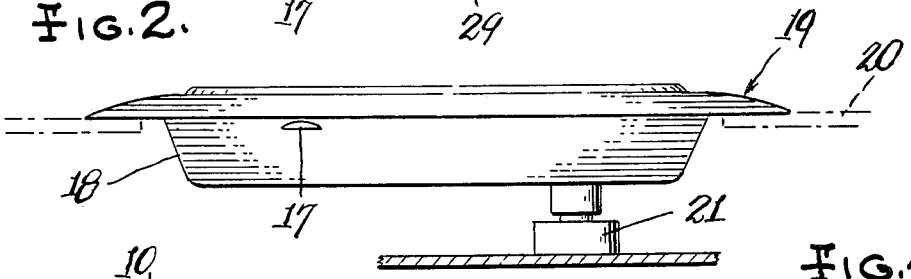
FIG. 3.
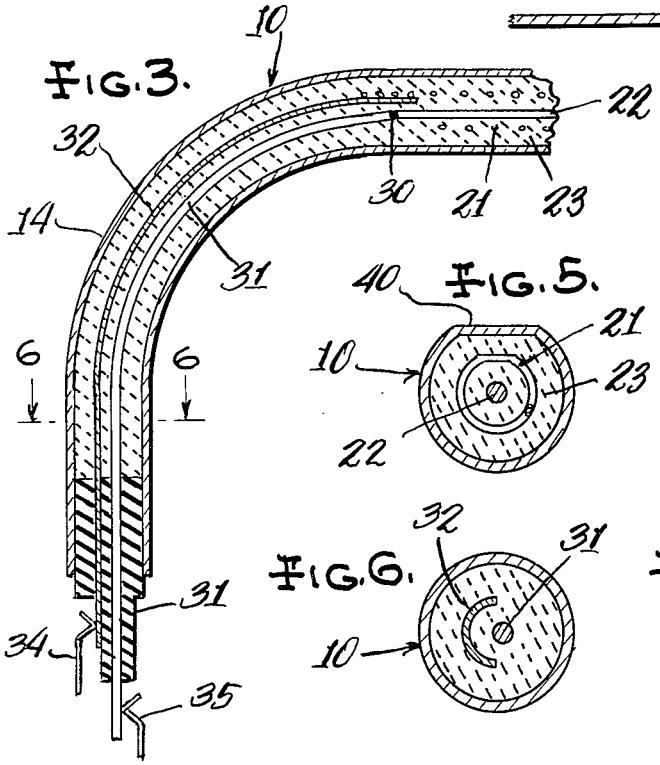
FIG. 4.
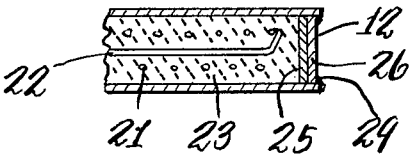
FIG. 5.
FIG. 7.
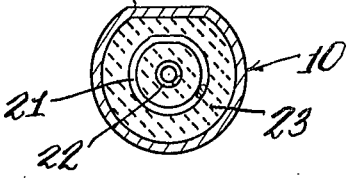
FIG. 6.
FIG. 8.
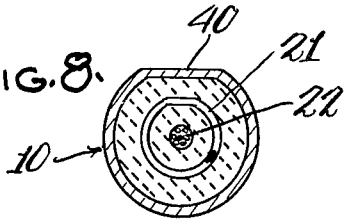

ELECTRIC HEATING ELEMENTS

BACKGROUND AMD SUMMARY

Sheathed electric heating elements, and particularly range surface units, of the general type to which this invention relates, are well known in the art. For illustrative examples of some units of the prior art, reference is made to U.S. Pat. No. 2,508,552, issued May 23, 1950, to W. R. Tuttle, and U.S. Pat. No. 2,550,843, issued May 1, 1951, to J. McOrlly.

Over the ensuing years, many refinements have been made to increase the efficiency of such prior art units, and millions have been made and sold because of their recognized ability to function in acceptable manner.

However, one thing that has troubled the industry prior to my invention is the manner in which units of this type fail, if and when they ultimately fail. It is well known to those in the industry that metal sheath range surface units of prior art design reach an end of life in an unpredictable mode of failure. Some units may fail in a passive manner with nothing more than a parting of the resistor alloy to create an open circuit. Other units may fail with a breakdown of insulation resistance to the grounded metal sheath, and this breakdown causes an electrical arc to be generated which melts the resistor alloy and metal sheath similar to the arc of an electric arc welder.

The energy created by the arc is sometimes sufficient to cause molten metal of fusion to be expelled in a violent manner, so as to burn holes in the bottom of cooking utensils, but more seriously, to shower molten metal particles about the area. While damage from this violent type of failure has usually been minimal, nevertheless there exists the potential of fire or bodily injury.

My invention minimizes or completely eliminates the hazards above-mentioned through changes in the internal design of the range surface unit. In the improved form, the usual helical resistance coil is embedded within refractory material which is in compacted condition within the metal sheath. A return conductor is disposed within the coil and is electrically connected to one end of the resistance coil, and extends through the latter to the other end thereof where it and the other coil ends are connected to terminal conductors for connection to a source of electrical energy.

DESCRIPTION OF THE DRAWING

In the drawing accompanying this specification and forming a part of this application, there is shown, for purposes of illustration, an embodiment which my invention may assume, and in this drawing:

FIG. 1 is a plan view of a range surface unit, illustrating a preferred embodiment of my invention, FIG. 2 is a fragmentary side view thereof, FIG. 3 is an enlarged, fragmentary sectional view corresponding to the line 3—3 of FIG. 1, FIG. 4 is an enlarged, fragmentary sectional view corresponding to the line 4—4 of FIG. 1, FIG. 5 is an enlarged sectional view corresponding to the line 5—5 of FIG. 1, FIG. 6 is a sectional view corresponding to the line 6—6 of FIG. 3, and FIGS. 7 and 8, are views similar to FIG. 5, but showing slightly modified constructions.

DESCRIPTION OF THE PREFERRED EMBODIMENT

FIG. 1 discloses a range surface unit comprising a metal tube 10 having an active heating portion 11 in the form of a flat spiral in accordance with conventional design. One end of the tube is closed and its opposite end is provided with electrical terminations for connection to a source of electrical energy.

In the embodiment herein disclosed, the tube at the outer end of the flat spiral is closed, as shown at 12, while the inner end of the spiral is bent to extend laterally of the flat spiral and downwardly thereof, as shown at 14, to form a terminal leg. Insofar as my invention is concerned, the inner end of the flat spiral could be closed, and the terminal leg is formed at the outer end of the spiral.

The tube 10 is supported on a spider 15 of any desired construction, which spider has three radial legs 16. The ends of the legs 16 are supported on seats 17 formed in an annular upright wall 18 of an adaptor ring 19, in usual manner. The adaptor ring supports the heating assembly from a stove panel shown in dot-dash lines at 20, and the assembly is normally grounded through the stove in known manner. The terminals extending from the terminal leg 14 are adapted to have plug-in connection with a receptacle 21, although the particular type of electrical connection may be varied.

A coiled wire resistor 21 and a return conductor 22 are held in fixed relation within the tube 10 by means of compacted refractory insulation 23. An important aspect of my invention resides in the fact that the return conductor 22 is disposed within the coil 21, preferably centrally thereof as seen in FIG. 5, and that the dielectric spacing between the resistance member and the sheath is not less than the dielectric spacing between the resistance conductor and the return conductor. The coil 21 is preferably disposed centrally of the tube 10 and the compacted refractory material maintains these relationships between tube, coil and return conductor and insures adequate dielectric material and spacing between the resistance coil and sheath, and between the resistance coil 21 and the return conductor 22.

It is presently preferred to use a wire of solid cross-section and suitable current capacity as the return conductor 22, although such conductor may take the form of a wire coil, as shown in FIG. 7, or stranded wire, as shown in FIG. 8.

In order to prevent entrance of contaminates, the tube end 12 may be closed in the manner shown in FIG. 4, wherein two metal discs 25 and 26 are utilized. The inner disc 25 is first forced into the end of the tube, and displaces refractory material inward of the tube, so that the outer disc is relatively free of such material and may be annularly welded to the tube, as shown at 29.

As best seen in FIG. 4, an end of the return conductor 22 is electrically connected to the adjoining end of the resistor coil 21. The return conductor extends through the full length of the coil to the terminal leg 14 of the tube, at which place both conductor and resistor are joined to terminals which extend outwardly of the sheath for connection to a source of electrical energy.

As seen in FIG. 3, the return conductor 22 is connected, as by a fused joint 30, to a terminal pin 31. If such return conductor is a solid wire of suitable size, its end may form the terminal pin 31. The resistor coil 21 is connected to a conductor strip 32 which is arcuate in cross-section, as seen in FIG. 6, or is of any other suitable form. The terminal pin 31 and strip 32 extend through a closure bushing 33 and are arranged for engagement with the spring contacts 34, 35 of the receptacle 21. The tube 10 in its final form may be round in cross-section, or may be pressed to form a flat area on its top surface, as shown at 40.

In a range unit, or any other type of sheathed unit having a plurality of bends throughout the length thereof, made in accordance with my invention, the mode of failure is in a passive manner with no rupturing of the sheath or violent emission of molten metal, and the theory for this passive failure is as follows.

As the resistor wire 21 approaches end of life, there are sections of the wire that will vary in resistance due to changes in composition with temperature and time. Those sections that increase in resistance, in series with sections at lower resistance, will develop higher operating temperature and will appear as hot spots on the surface of the unit. On surface units of prior art design, these hot spots bring about a lowering of insulation resistance with increased temperature to the point that voltage breakdown between the coil and grounded sheath may occur and with the subsequent resultant violent failure mentioned in an early part of this description.

In my improved unit, the hot spots that do develop are at the highest temperature in the center of the cross-section through the sheath, and they cause insulation strength (volts/mil) between the resistor coil 21 and return conductor 22 to be lower than the insulation strength from the coil 21 to the grounded sheath. Considering this fact, the geometry of the cross-section is such that the voltage breakdown will occur between the resistor coil 21 and the center return conductor 22 with the electrical shorting occuring between the two at the hot spot. Since it is well known that the current will follow the path of least resistance, the shorting effect will progress along the resistor coil 21 and return wire 22 in a direction toward the terminal end of the unit until the voltage stress and energy present are sufficient to cause the resistor and/or return conductor to melt and create an open circuit condition. This internal open circuit occurence does not cause rupture of the sheath and possible expulsion of molten metal. Laboratory tests have been conducted with units made in accordance with my invention and failures were induced deliberately to create hot spots at various locations along the sheath of such unit. In each test, the unit failed in a predictably safe manner.

My improved electric heating element may be made in various manners. In each case it is preferred to start with a rectilinear metal sheath that is round in cross-section. One end of the sheath (the end 12) may be closed prior to assembly with the resistance conductor and return conductor or this end may be closed at a later time.

In one mode of assembly, ceramic beads of well known form may be strung over the return conductor, and the resistance member then coiled about the beads and electrically joined at one end with one end of the return conductor. Terminals may be secured to the opposite pair of ends. Ceramic beads may then be threaded over the resistance member and this subassembly inserted into the sheath, the last named beads having fluted peripheries to pass granular refractory which completely fills the sheath. The sheath may be rolled or side-pressed to compact the granular refractory material and the ceramic beads into a homogenous rock-like mass. The sheath is subsequently annealed, and is bent to its non-rectilinear shape, such as the spiral formation and terminal leg shown in the drawing.

Instead of utilizing the ceramic beads mentioned above, the resistance member and return conductor may be held taut in concentrically spaced relation, and granular refractory material then flowed into the sheath.

I claim:

1. An electric heating element, comprising:

a tubular metallic sheath formed to non-rectilinear shape and having an active heating portion, one end of said sheath being closed and the other end constituting a terminal leg projecting laterally from said active heating portion, said sheath being adapted for mounting in grounded relation on an appliance, a coiled resistance member extending longitudinally within said sheath throughout said active heating portion, having one end terminating adjacent to the closed end of said sheath and the opposite end terminating adjacent to the sheath terminal leg, a bare return conductor within said coiled resistance member and generally coextensive therewith, one end of said return conductor being electrically connected to said one end of said resistance member, the other end of said return conductor and said opposite end of said resistance member having terminals which extend outwardly of said terminal leg and through an insulating bushing which closes the open end of said terminal leg, said terminals being adapted for connection to a source of electrical energy to energize said resistance member and thereby create heat, compacted refractory material entirely filling said sheath between said return conductor, resistance member and said sheath and maintaining said sheath, said resistance member and said return conductor in electrically insulated relation while conducting heat from said resistance member to said sheath, the geometry of a cross-section taken anywhere through said sheath in said active heating portion being such that, during energization of said resistance member to create heat, the insulation resistance between said resistance member and said return conductor is less than the insulation resistance between said resistance member and said sheath, whereby voltage breakdown caused by a hot spot in said active heating portion will occur between said resistance member and said return conductor to short therebetween until the voltage stress causes one of said resistance member and said return conductor to rupture and create an open electrical circuit.

2. The construction according to claim 1 wherein said resistance member is a helically coiled wire of electrically resistant alloy.

3. The construction according to claim 1 wherein said return conductor is a wire.

4. The construction according to claim 1 wherein said return conductor is a helically coiled wire of smaller diameter than said coiled resistance member.

5. The construction according to claim 1 wherein said return conductor is a stranded wire.

6. The construction according to claim 1 wherein said electric heating element forms a flat spiral for supporting a utensil and defining said active heating portion with said sheath terminal leg extending downwardly therefrom.

* * * * *